US005439178A

United States Patent [19]

Peterson

[11] Patent Number: 5,439,178

[45] Date of Patent: Aug. 8, 1995

[54] PUMP DEVICE INCLUDING MULTIPLE FUNCTION COLLAPSIBLE PUMP CHAMBER

[75] Inventor: Robert J. Peterson, Loveland, Ohio

[73] Assignee: The Procter & Gamble Company, Cincinnati, Ohio

[21] Appl. No.: 203,913

[22] Filed: Feb. 28, 1994

Related U.S. Application Data

[63] Continuation-in-part of Ser. No. 82,001, Jun. 24, 1993, Pat. No. 5,303,867.

[51] Int. Cl.[6] ..... B05B 11/02; B05B 1/34

[52] U.S. Cl. ..... 239/333; 239/463; 239/468; 239/471; 222/209; 222/212; 222/383.3

[58] Field of Search ..... 239/329, 331, 333, 463, 239/468, 471; 222/207, 209, 212, 214, 383

[56] References Cited

U.S. PATENT DOCUMENTS

| | | | |
|---|---|---|---|
| 2,774,518 | 12/1956 | Greene | 222/209 |
| 2,824,672 | 2/1958 | Wersching | 222/207 |
| 3,124,275 | 3/1964 | Lake . | |
| 3,193,154 | 7/1965 | Bross | 222/207 |
| 3,471,092 | 10/1969 | Hickey | 239/573 X |
| 3,752,366 | 8/1973 | Lawrence et al. | 222/207 |
| 3,910,444 | 10/1975 | Foster . | |
| 3,973,700 | 8/1976 | Schmidt et al. . | |
| 4,082,223 | 4/1978 | Nozawa | 239/333 |
| 4,101,057 | 7/1978 | LoMaglio | 222/207 |
| 4,120,429 | 10/1978 | Vignot | 222/207 |
| 4,147,282 | 4/1979 | Levy . | |
| 4,204,614 | 5/1980 | Reeve | 222/207 X |
| 4,220,264 | 9/1980 | Gamadia | 222/207 |
| 4,232,828 | 11/1980 | Shelly, Jr. | 239/329 |
| 4,260,079 | 4/1981 | Cary et al. | 222/209 |
| 4,273,290 | 6/1981 | Quinn | 239/333 X |
| 4,310,104 | 1/1982 | Takatsuki . | |
| 4,313,568 | 2/1982 | Shay | 239/333 |
| 4,318,498 | 3/1982 | Magers et al. . | |
| 4,336,895 | 6/1982 | Aleff | 222/207 |
| 4,358,057 | 11/1982 | Burke | 239/333 |
| 4,589,574 | 5/1986 | Foster . | |
| 4,624,413 | 11/1986 | Corsette | 239/333 |
| 4,640,444 | 2/1987 | Bundschuh | 239/333 X |
| 4,651,904 | 3/1987 | Schuckmann | 222/383 |
| 4,655,690 | 4/1987 | Boedecker et al. . | |
| 4,732,549 | 3/1988 | von Schuckmann . | |
| 4,781,311 | 11/1988 | Dunning et al. . | |
| 4,846,372 | 7/1989 | von Schuckmann . | |
| 4,858,478 | 8/1989 | Kush et al. . | |
| 4,858,788 | 8/1989 | Meckenstock | 222/207 |
| 4,863,070 | 9/1989 | Andris | 222/207 |
| 4,898,307 | 2/1990 | Tiramani | 222/207 |
| 4,915,601 | 4/1990 | von Schuckmann . | |
| 4,979,646 | 12/1990 | Andris . | |

(List continued on next page.)

FOREIGN PATENT DOCUMENTS

| | | | |
|---|---|---|---|
| 0520315 | 12/1992 | European Pat. Off. . | |
| WO93/14983 | 1/1993 | European Pat. Off. . | |
| WO94/13547 | 12/1993 | European Pat. Off. . | |
| 1442883 | 5/1966 | France . | |
| 2305365 | 3/1975 | France . | |
| 2380077 | 9/1978 | France . | |
| 2524348 | 10/1983 | France | 239/333 |
| 2621557A | 10/1987 | France . | |
| 2630712A | 4/1988 | France . | |
| 3909633 | 10/1990 | Germany . | |
| WO92/22495 | 6/1991 | WIPO . | |

*Primary Examiner*—William Grant
*Attorney, Agent, or Firm*—Michael E. Hilton; John M. Howell; J. C. Rasser

[57] ABSTRACT

A collapsible pump chamber is provided which includes several functional elements of a pump device. For example, the collapsible pump chamber may be a bellows which includes a functional element of an outlet valve, a functional element of a biasing feature, and a functional element of a spin chamber. Consequently, a functional element of all of the downstream functions are incorporated into the bellows. This can significantly reduce costs due to reduced tooling and assembly, for example. In contrast, there are no upstream components incorporated into the bellows which enables the upstream or inlet end of the bellows to be wide open. This wide open upstream end of the bellows makes molding easier.

20 Claims, 15 Drawing Sheets

U.S. PATENT DOCUMENTS 5,014,881 5/1991 Andris ..... 222/207
5,018,894 5/1991 Goncalves .
5,031,802 7/1991 Joulia .
5,042,694 8/1991 Birmelin .
5,096,094 3/1992 Guilbert .
5,114,052 5/1992 Tiramani et al. ..... 222/207
5,158,211 10/1992 Meshberg .
5,158,233 10/1992 Foster et al. ..... 239/333
5,190,190 3/1993 Fudalla .
5,195,878 3/1993 Sahiavo et al. .
5,197,866 3/1993 Kim .
5,205,441 4/1993 Andris ..... 222/207
5,234,166 8/1993 Foster et al. ..... 239/333
5,303,850 4/1994 Connan .
5,303,867 4/1994 Peterson ..... 239/333
5,333,761 8/1994 Davis et al. .
5,351,862 10/1994 Weag ..... 222/209 X

PUMP DEVICE INCLUDING MULTIPLE FUNCTION COLLAPSIBLE PUMP CHAMBER

This is a continuation-in-part of application Serial No. 08/082,001, filed on Jun. 24, 1993, now U.S. Pat. No. 5,303,867.

BACKGROUND OF THE INVENTION

1. Field of the Invention

The present invention relates to manually operated liquid dispensing pump devices for use with consumer product containers; and more particularly, to such devices having a collapsible pump chambers (e.g., a bellows pump chamber) which perform multiple functions.

2. Description of the Prior Art

Manually operated dispensing devices for pumping liquid from a supply container are widely known in the art. These liquid dispensers traditionally utilize a piston and cylinder pump chamber. A helical metal spring is generally utilized to provide the force necessary to return the piston to its initial position. Additional parts are generally related to an inlet valve, an outlet valve and a vent valve. Furthermore, in cases where a liquid spray discharge is desired, additional parts are often related to a swirl chamber. One disadvantage of such piston and cylinder dispensing devices is the great amount of sliding friction developed between the piston and the cylinder due to the tight telescopic fit required to maintain a fluid tight seal. Binding, may also occur between the piston and cylinder. Another disadvantage includes the relatively large number of parts such sprayers typically utilize which generally increases the cost of such pumps.

Consequently, attempts to utilize a manually compressible flexible pump chamber in place of the piston and cylinder have been made. For example, bellows have been utilized to replace the function of the piston, cylinder and return spring. Still other liquid dispensing devices have utilized a diaphragm or bladder as the manually compressible pump chamber. The use of such manually compressible pump chambers is substantially free of friction and the potential binding losses associated with the piston and cylinder. Some of these pump devices have integrally molded duckbill, flapper and/or annular sealing valves with the pump chamber. One disadvantage in the use of such valves is that they do not readily enable the further integral molding of additional functions. Thus, additional parts are generally required; thereby increasing the cost of the pump device. Furthermore, the integral molding of reliable valves can be difficult.

SUMMARY OF THE INVENTION

A manually operated liquid dispensing device is provided. The dispensing device includes a housing for sealingly mounting the dispensing device to a supply container. Additionally, a liquid passage provides fluid communication from the supply container downstream to the discharge orifice. An inlet valve is located within the liquid passage. The inlet valve closes to prevent the fluid flow therethrough during periods of positive upstream pressure and opens to permit fluid flow therethrough during periods of negative downstream pressure. An outlet valve is located downstream of the inlet valve within the liquid passage. The outlet valve is open to permit fluid flow therethrough during periods of positive upstream pressure and is closed to prevent fluid flow therethrough during periods of negative upstream pressure. A collapsible pump chamber (which is preferably resilient) defines a portion of the liquid passage downstream of the inlet valve and upstream of the outlet valve.

In accordance with one aspect of the present invention the dispensing device further includes a swirl chamber defining the terminal portion of the liquid passage. The swirl chamber includes a first functional element which has the discharge orifice therein and a second functional element which is an integral component of the collapsible pump chamber.

In accordance with another aspect of the present invention the dispensing device further includes a biasing feature for biasing the outlet valve or inlet valve closed. The biasing feature includes a functional element which provides some portion of the biasing force which is an integral component of the collapsible pump chamber.

In accordance with another aspect of the present invention the outlet valve, the inlet valve, or both include a valve member which is capable of being biased against a cooperating valve seat by an axial biasing force. Additionally, the valve member is an integral component of the collapsible pump chamber.

BRIEF DESCRIPTION OF THE DRAWINGS

While the specification concludes with claims particularly pointing out and distinctively claiming the present invention, it is believed the present invention will be better understood from the following description in conjunction with the accompanying drawings in which:

DETAILED DESCRIPTION OF THE INVENTION

Figure 1:
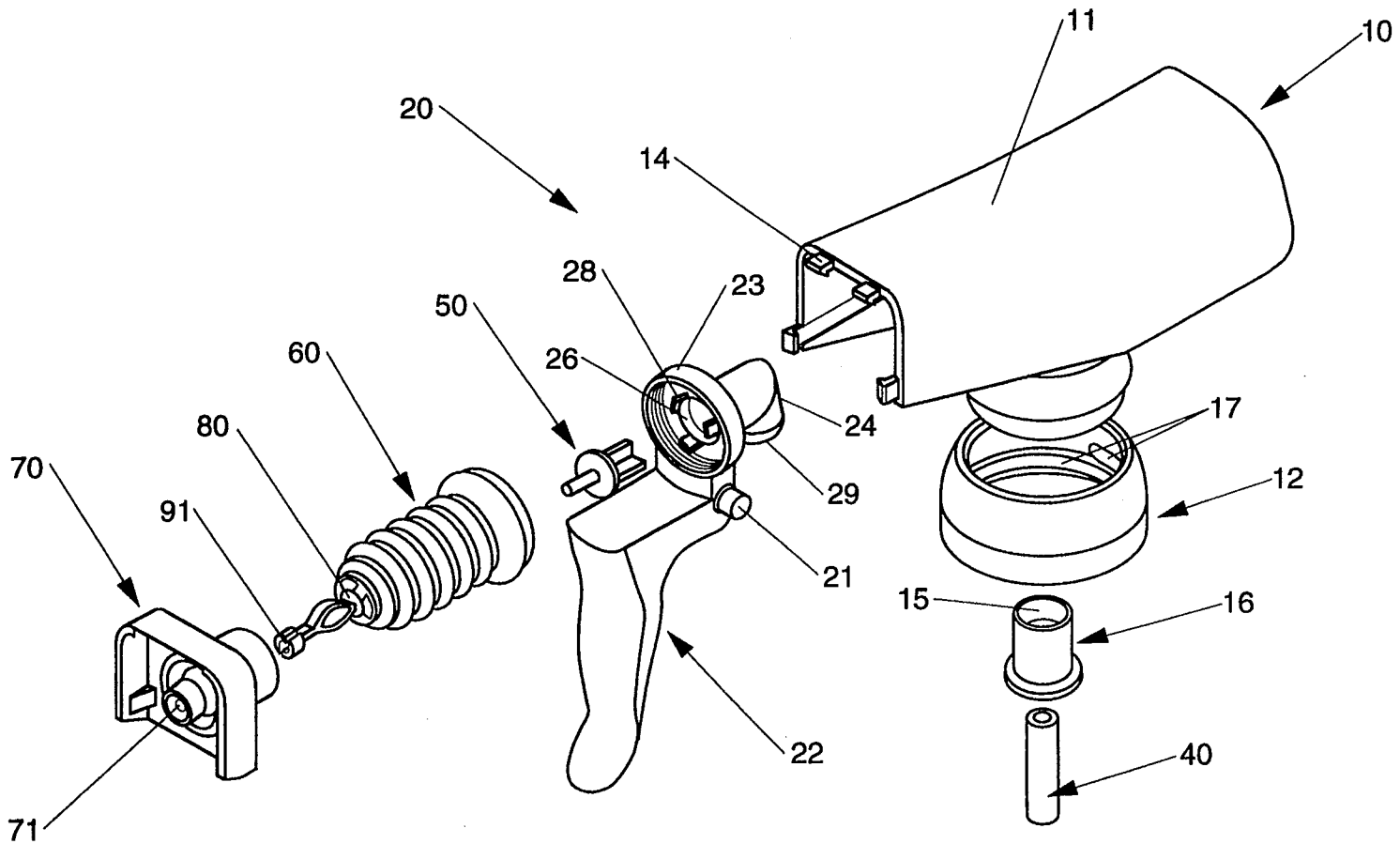
FIG. 1 is an exploded perspective view of a particularly preferred liquid dispensing pump device of the present invention.
Figure 2:
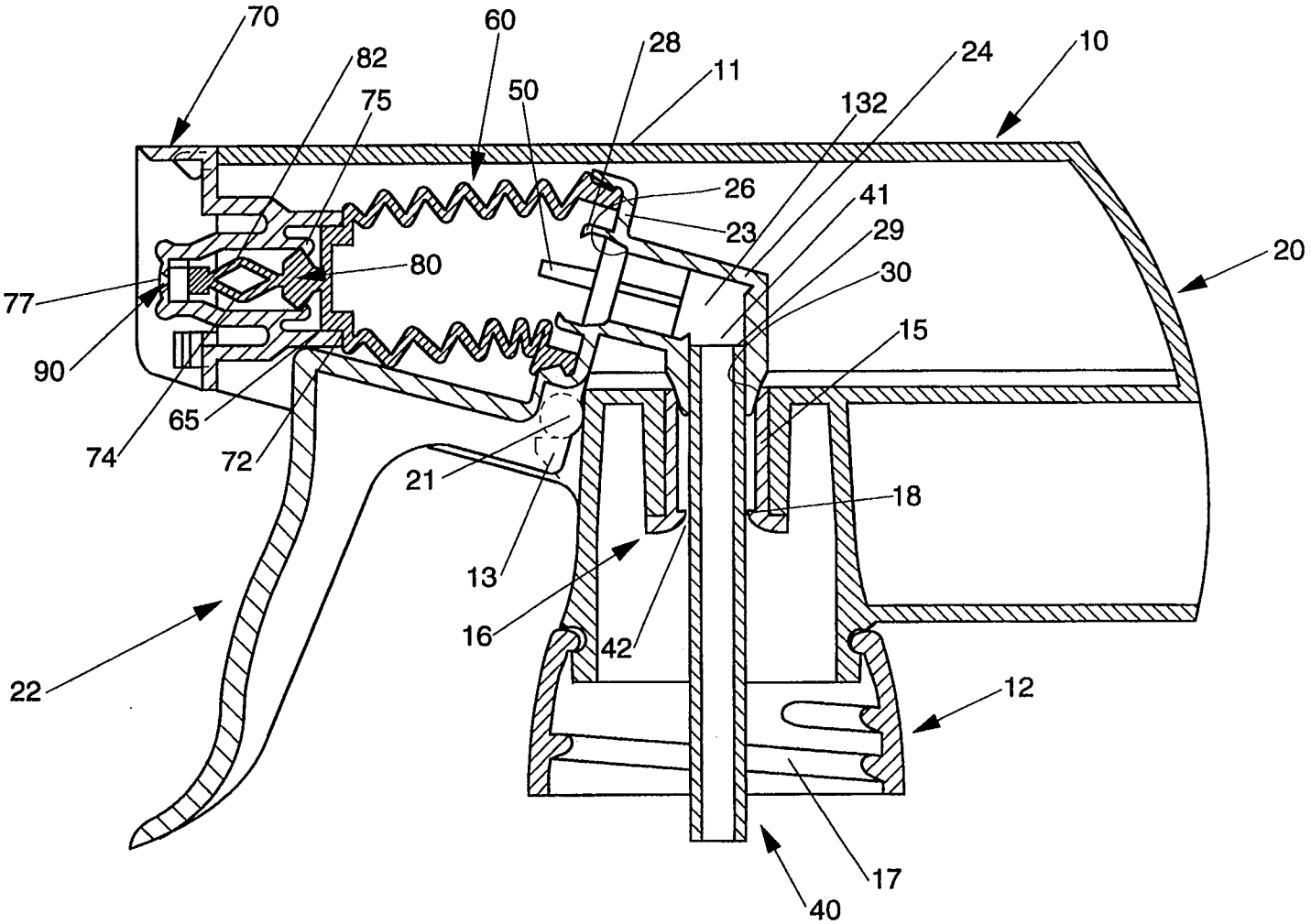
FIG. 2 is a cross-sectional view, taken along the center line, of the assembled liquid dispensing pump device of FIG. 1.

In FIG. 1 there is seen, in exploded perspective view, a particularly preferred liquid dispensing pump device of the present invention, indicated generally as 20. A cross-sectional view of this particularly preferred, fully assembled, liquid dispensing pump device 20 is seen in FIG. 2; and is seen in operation in FIG. 3. The illustrated liquid dispensing pump device 20 basically includes an inlet valve member 50; a trigger 22; a vent tube 16; a dip tube 40; a housing 10 including a nozzle 70, a shroud 11, and a closure 12; and a collapsible pump chamber 60.

As used herein, the phrase "collapsible pump chamber" is defined as a pump chamber delineated—at least partially—by a flexible wall which moves in response to a manual compressive force in such a way that the volume within the pump chamber is reduced without sliding friction between any components delineating the pump chamber. Such compressible pump chambers may include balloon-like diaphragms and bladders made from elastomeric materials such as thermoplastic elastomers, elastomeric thermosets (including rubber), or the like. For example (not seen), the collapsible pump chamber may include a helical metal or plastic spring surrounding (or covered by) an elastic material; creating an enclosed pump chamber. However, the preferred collapsible pump chamber 60 is a bellows; i.e., a generally cylindrical, hollow structure with accordion-type walls. Bellows are preferred, for example, because they can be made resilient to act like a spring; eliminating the need for a spring. Furthermore, the collapsible pump chamber includes one or more integral elements which enable to collapsible pump chamber to perform multiple functions. As used herein, the term "integral" is defined as molded, or otherwise formed, as a single unitary part.

The housing 10 is used for sealingly mounting the liquid dispensing device 20 to a liquid supply container (not seen) via the closure. The illustrated closure 12 includes screw threads 17 for attaching the housing 10 to the container (not seen). Alternatively, the closure 12 may utilize a bayonet-type attachment structure (not seen) such as that described, for example, in the following U.S. Patents hereby incorporated herein by reference: U.S. Pat. No. 4,781,311 issued to Dunning et al. on Nov. 1, 1988; and U.S. Pat. No. 3,910,444 issued to Foster on Oct. 7, 1975. Also, the closure 12 may be integral with the shroud 11. The illustrated shroud 11 includes an integral "C"-shaped hinge 13 for attaching the trigger 22 to the housing 10; and a plurality of tabs 14 for attaching the nozzle 70 to the housing 10. Additionally, the illustrated housing 10 includes a vent tube 16 having a vent valve seat 15. Alternatively, the vent tube 16 and its vent valve seat 15 and may be integral (not seen) with either the shroud 11 or the closure 12. The housing 10 may be molded from one or more thermoplastic materials, such as polypropylene, polyethylene or the like.

Passing through the housing 10 is a liquid passage which is delineated by several parts, including the dip-tube 40, the tubular pipe 24, the collapsible pump chamber 60, and the nozzle 70. The liquid passage provides fluid communication from the distal end of the dip tube 40 within the supply container (not seen) in a downstream direction to the discharge orifice 77 of the nozzle 70. As used herein, the term "downstream" is defined as in the direction from the supply container (not seen) to the nozzle 70; and "upstream" is defined as in the direction from the nozzle 70 to the supply container (not seen). Similarly, as used herein, the phrase "inlet end" means the upstream end; and the phrase "outlet end" means the downstream end.

A portion of the liquid passage is provided by a tubular pipe 24 which is integral with the trigger 22. The trigger 22 is utilized to manually compress the collapsible pump chamber 60, as described hereinafter. The trigger 22 is attached to the housing 10 by the hinge 13 through an integral cylindrical pivot 21; allowing the trigger 22 to rotate freely relative to the housing 10. The trigger 22 further comprises an angled tubular pipe 24, a pump coupler 23, an inlet valve seat 26, and a vent valve member 29, all preferably integral with the trigger 22. The trigger 22 may be molded from a thermoplastic material such as polypropylene, polyethylene, or the like.

The exterior surface of the upstream end of the tubular pipe 24 is conically shaped, forming a vent valve member 29. Additionally, a conically shaped valve seat is provided by the vent tube 16. Thus, the vent valve member 29 and the vent valve seat 15 form a vent valve 15 and 29. The vent valve 15 and 29 is biased closed due to the resiliency of the bellows 60 to seal the vent channel 42 between the dip tube 40 and the vent tube 16. When the trigger 22 is manually rotated about the pivot 21, the vent valve 15 and 29 opens; thereby providing fluid communication via the vent channel between the interior of the container (not seen) and the atmosphere; permitting the internal pressure within the container (not seen) to equalize with the atmosphere as liquid is dispensed from the container (not seen) through the pump device 20.

Additionally, the dip tube 40 which is friction fit within the tubular pipe 24 provides another portion of the liquid passage. The dip tube 40 is preferably held by the tubular pipe 24 at an angle with respect to the pump coupler 23. This angle is preferably equal to one half the maximum rotational angle through which the trigger 22 is rotated when liquid dispensing pump device 20 is attached to the liquid supply container (not seen). The dip tube 40 is preferably formed of thermoplastic material such as polypropylene, polyethylene, or the like.

A liquid inlet valve 50 is located within the liquid passage and attached to the pump coupler 23 via the retaining tabs 28. The retaining tabs are circumferentially positioned around the valve seat 26 to retain the inlet valve member 50 when liquid flows downstream through the liquid passage. The liquid inlet valve 26 and 50 may be of any type generally known in the art including a duckbill, ball, poppet, or the like. The illustrated liquid inlet valve 26 and 50 includes a poppet-type valve member 50 and a conically shaped valve seat 26. Thus, the inlet valve member 50 cooperates with the inlet valve seat 26 to seal the liquid passage under positive downstream pressure conditions.

Another portion of the liquid passage is defined by the collapsible pump chamber 60. The collapsible pump chamber 60 has a structure which is flexible such that it can be manually compressed; thereby reducing the volume within the collapsible pump chamber 60. Although a spring (not seen) may be utilized to help return the collapsible pump chamber 60 to its original shape, the collapsible pump chamber 60 is preferably sufficiently resilient that it returns to its initial shape when the manual compression force is released.

The illustrated collapsible pump chamber is a bellows. A preferred bellows should have several qualities. For example, the bellows should make the pump device easy to actuate. Generally this means having a spring force from about three pounds to about five pounds. The bellows should also have good resiliency with minimal hysterisis and creep. Furthermore, the bellows preferably has good stiffness in the radial direction (hoop strength) to ensure the bellows is not radially deformed under normal operating conditions. Lastly, the bellows preferably has a good volumetric efficiency; i.e., change in internal volume divided by the total expanded internal volume.

Some geometric features which can be utilized to endow the bellows with the appropriate qualities include the diameter of the bellows. The larger the diameter the lower the spring force and the lower the radial stiffness. Although lower spring force is generally desirable, lower radial stiffness can be a problem; e.g., the bellows might blow out in a precompression trigger sprayer. Increasing the wall thickness of the pleats will increase radial stiffness but it increases the spring force and results in decreased volumetric efficiency of the bellows. Reducing the pleat angle generally decreases the spring force but decreases the volumetric efficiency. The pleat angle is the aggregate of two angles; the angle above a line normal to the axis and passing through the origin of a pleat and the angle below that line. Preferably, the pleat angle above the normal line is about 30° and the pleat angle below the normal line is about 45° (making removal of the bellows from the core pin easier). Increasing the number of pleats will lower the spring force and lower the volumetric efficiency.

Although not wishing to be bound, it is believed that the major components of the spring force are the wall thickness and the upper and lower pleat angles while the major component of resiliency is material selection.

Material selection can also help endow the bellows with the appropriate qualities. In general the material preferably has a Young's modulus below 10,000 psi. For lotion pumps, a Young's modulus below 3,000 psi is preferred. The material should enable retention of mechanical properties, be dimensionally stable and be resistant to stress cracking. These properties should be present over time in air and in the presence of the liquid product. Thus, for trigger sprayers which generally spray acidic or alkaline cleaning products comprised of significant quantities of water the material should not be pH sensitive and should not undergo hydrolysis. Exemplary such materials include polyolefins such as polypropylene, low density polyethylene, very low density polyethylene, ethylene vinyl acetate. Other materials which may be utilized include thermosets (e.g., rubber), and thermoplastic elastomers. Most preferred for trigger sprayers is a high molecular weight ethylene vinyl acetate with a vinyl acetate content between about 10 and 20 percent. For other pumps (e.g., lotion pumps) pH and hydrolysis may not be an issue. Instead a low spring force with a high resiliency may be more important. In such cases a low modulus ethylene vinyl acetate or a very low density polyethylene are preferred.

An exemplary bellows made of ethylene vinyl acetate or very low density polyethylene might have a 0.6 in inner large diameter and a 0.4 inch inner small diameter and a wall thickness of between about 0.02 inch and 0.03 inch. The aggregate pleat angle would be about 75°; with the upper pleat angle 30° and the lower pleat angle 45°.

The bellows, which provides the manually compressible pump chamber 60 of this embodiment, is attached to the housing 10 via the pump coupler 23 of the trigger 22. The downstream, or inlet, end of the bellows 60 is attached to the pump coupler 23 via cooperating annular ribs 31 and 62. The cooperating ribs 31 and 62 also help provide a liquid tight seal under positive pump pressure. Thus, the inlet end of the bellows 60 is in liquid communication with liquid supply container (not shown). The inlet end of the bellows 60 is wide open to permit reliable, cost effective thermoplastic molding.

Similarly, the outlet end of the bellows 60 is attached to the nozzle 70 via cooperating annular ribs 72 and 65 to provide a liquid tight seal under positive pump pressure. The nozzle 70 is attached to the shroud 11 through a plurality of tabs 14 that are positively engaged with an equal number of slots 78 in the nozzle 70. The nozzle 70 is in liquid communication with the outlet end of the bellows 60 and forms a portion of the liquid passage; including the discharge orifice 77. Furthermore, the nozzle 70 includes the outlet valve seat 72. The nozzle 70 may further include a hinged door (not seen) shipping seal which can be moved to a closed position sealing the discharge orifice 77—or to an open position permitting the discharge of liquid through the discharge orifice 77. The nozzle 70 may be molded from a thermoplastic material such as polypropylene, polyethylene, or the like.

Figure 4:
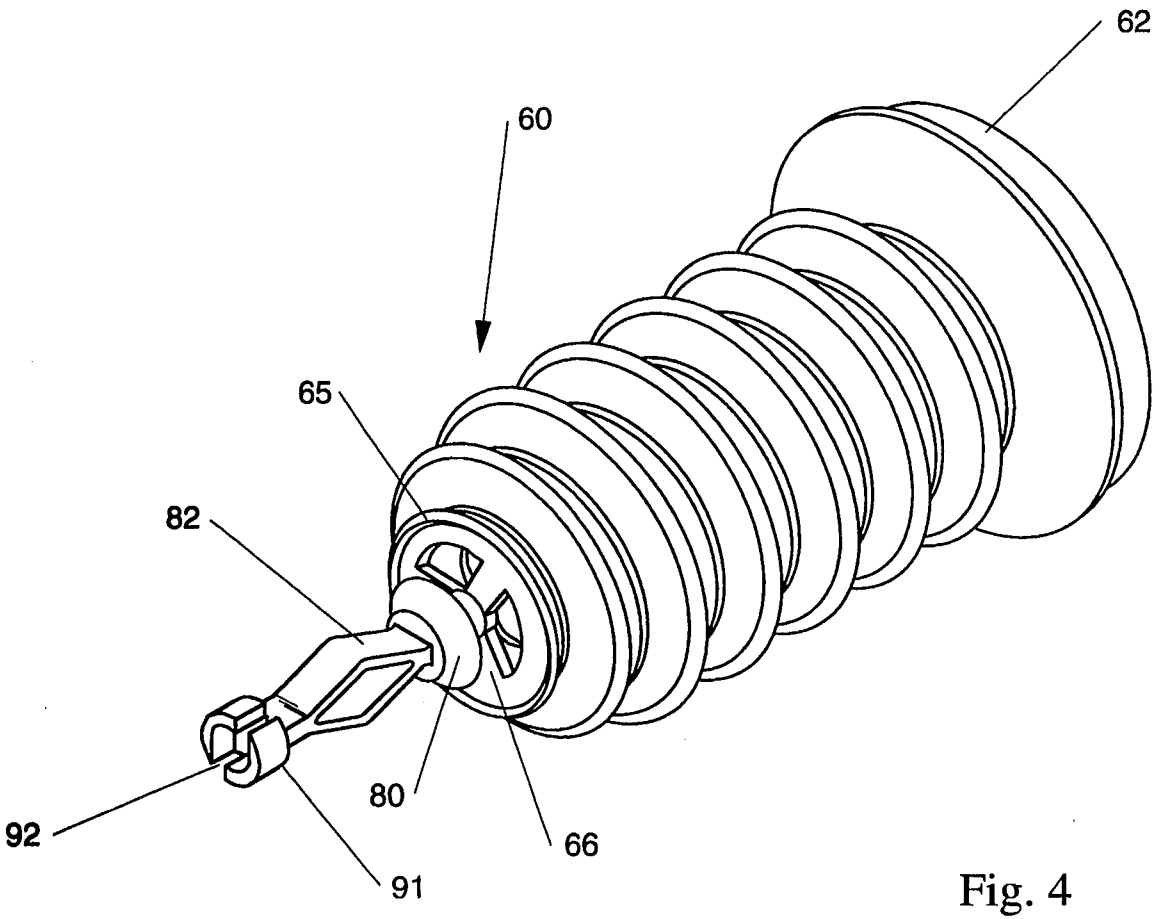
FIG. 4 is an enlarged perspective view of the multiple function collapsible pump chamber of the liquid dispensing pump device of FIG. 1.
Figure 5:
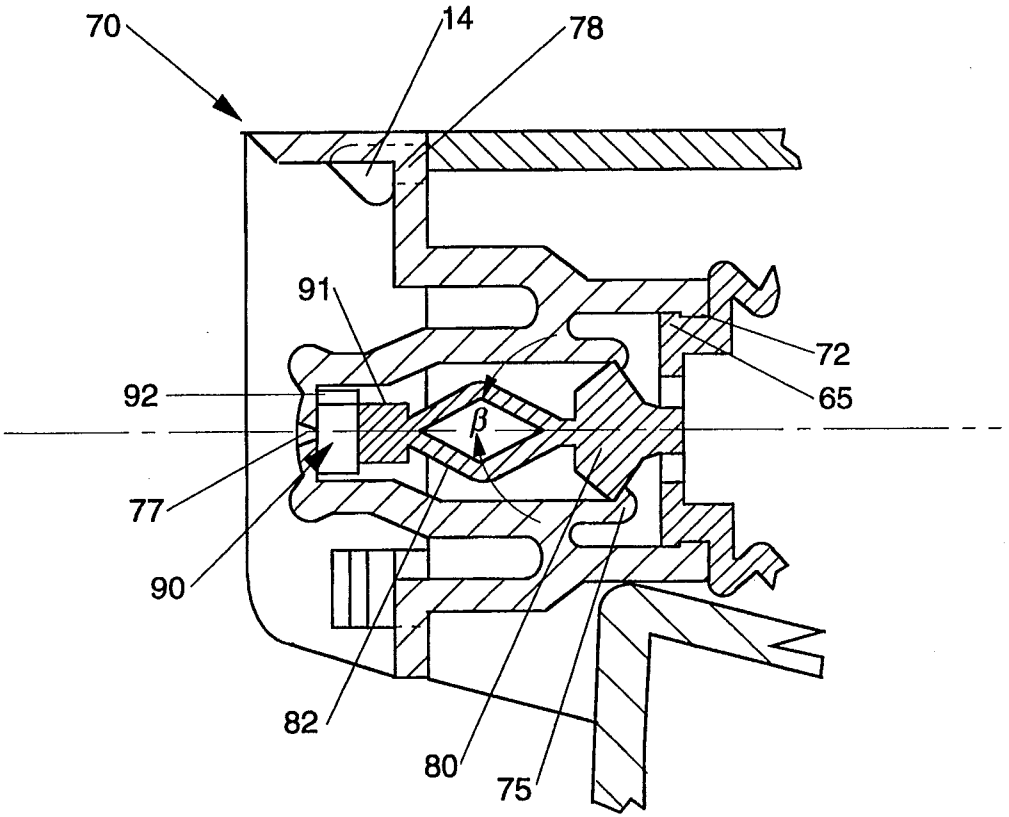
FIG. 5 is an enlarged, fragmentary cross-sectional view of the outlet end of the liquid dispensing pump device of FIG. 1.
Figure 6:
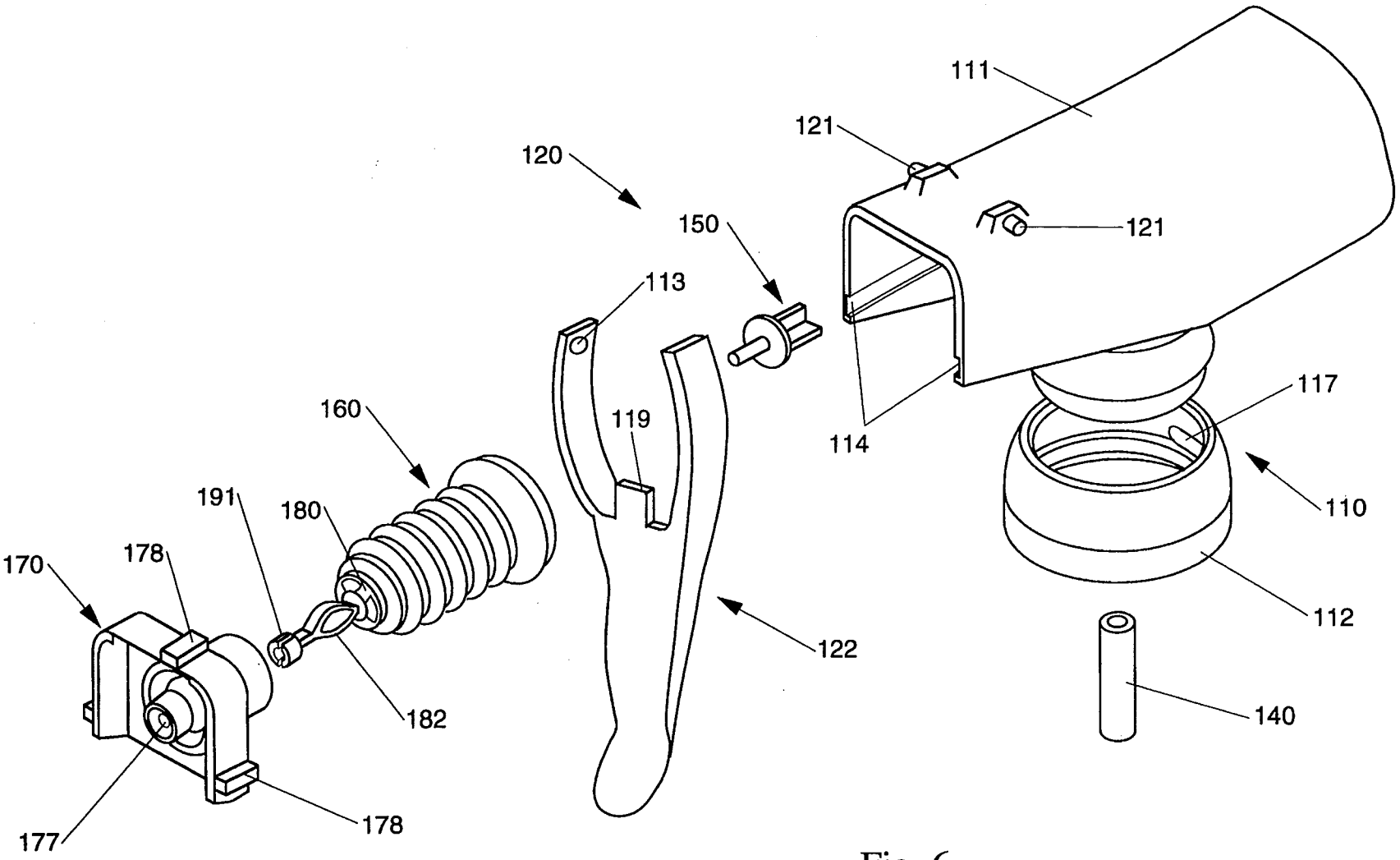
FIG. 6 is an exploded perspective view, similar to FIG. 1 of another particularly preferred liquid dispensing pump device of the present invention.
Figure 7:
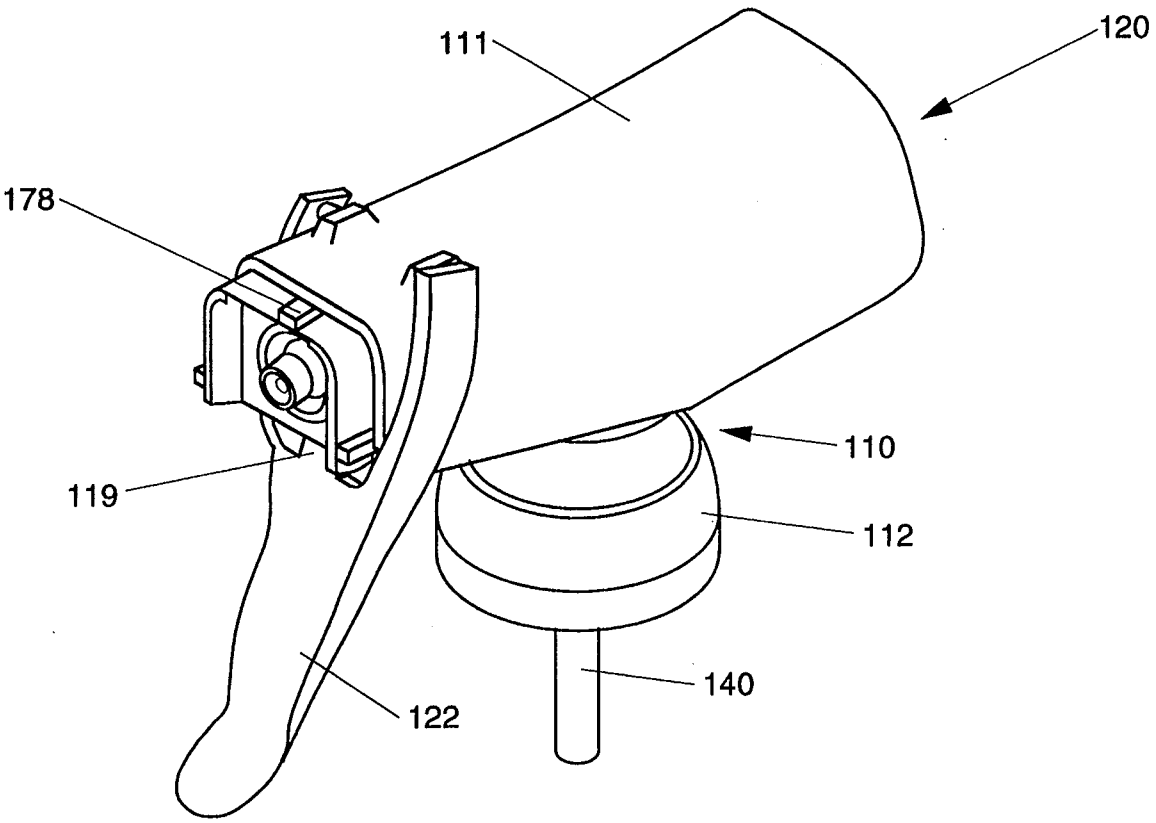
FIG. 7 is a perspective view of the fully assembled liquid dispensing pump device of FIG. 6.
Figure 8:
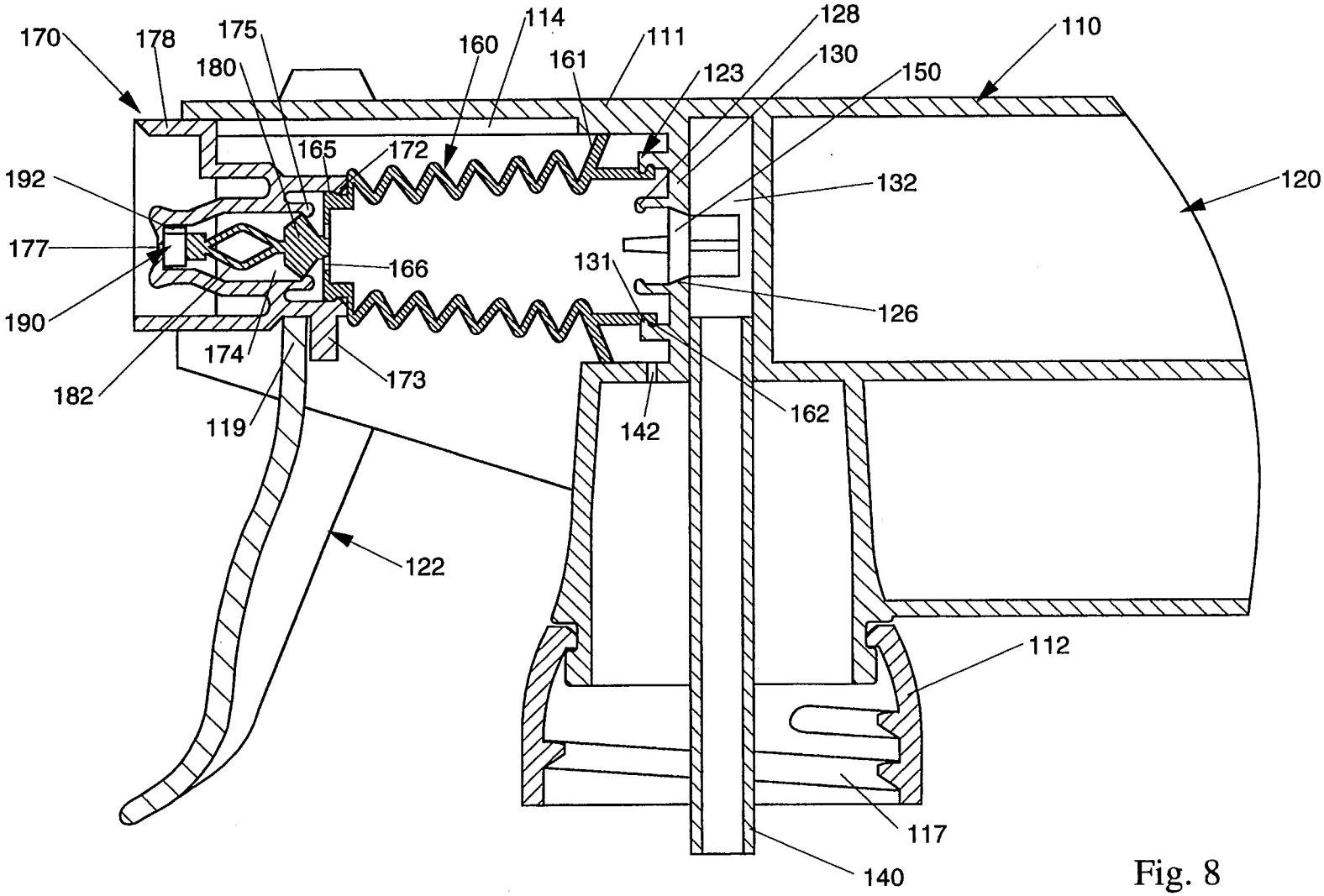
FIG. 8 is a cross-sectional view, similar to FIG. 2, of the assembled liquid dispensing pump device of FIG. 6.

Referring to FIGS. 4 and 5, the bellows 60 preferably includes an integral functional element of the swirl chamber 90. The swirl chamber 90 comprises the downstream terminal portion of the liquid passage. The illustrated swirl chamber 90 is defined by two parts; the nozzle 70, including an end wall 76 and the discharge orifice 77, and the spinner 91 which is integral with the downstream end of the bellows 60. The illustrated bellows 60 is directly in line with and adjacent to the nozzle 70. The spinner 91 has a generally hollow cylindrical shape with two arcuate channels 92 in the side wall which direct the liquid traveling therethrough tangentially toward the inner surface of the spinner's 90 side wall, and tangential to the axis of the discharge orifice 77. This imparts radial momentum to the liquid just prior to exiting said discharge orifice 77; aiding in spray formation. Alternatively, the swirl channels 92 may be molded integral with the nozzle 70 as seen, for example, in FIGS. 12, 14 and 15; discussed hereinafter. Examples of alternative springs and swirl chambers are disclosed in the following patents, hereby incorporated herein by reference: U.S. Pat. No. 4,273,290 issued to Quinn on Jun. 16, 1981; and U.S. Pat. No. 5,234,166 issued to Foster et al. on Aug. 10, 1993.

The bellows 60 is also preferably includes an integral functional element of the outlet valve. The outlet valve includes the outlet valve member 80 and the outlet valve seat 75. As illustrated, the outlet valve member 80 is the portion integral with the bellows 60 through two or more integrally formed flexible legs 66 that radially extend like spokes between the valve member 80 and the body of the bellows 60. The outlet valve seat 75 includes a conically shaped surface which cooperates with a conical surface on the outlet valve member 80. The outlet valve 75 and 80 is located within the liquid passage and operates to seal the passage under negative upstream pressure conditions. Alternative liquid outlet valves (not seen) may be of any type generally known in the art, including a duckbill, ball, poppet, or the like.

Preferably the outlet valve 75 and 80 or the inlet valve 26 and 50 is closed at rest such that the pump will not lose its prime between operations. More preferably, it is the outlet valve 75 and 80 which is closed, since this provides many benefits. For example, since the outlet valve 75 and 80 is closer to the discharge orifice 77, less product is likely to drip from the nozzle 70 when the outlet valve is closed. Even more preferably, the outlet valve 75 and 80 is biased closed. Most preferably, the outlet valve 75 and 80 is significantly biased closed such that precompression is provided. Precompression is provided at the consumer product flow rates typical of such pump sprayers when the outlet valve 75 and 80 remains closed until a pressure of about 50 psi is reached inside the bellows 60. Biasing helps provide good spray formation and helps give the spray stream a quick start and stop. As discussed hereinafter, the outlet valve 75 and 80 may be biased in such a way that the biasing force drops as the outlet valve 75 and 80 opens. As illustrated the biasing force can be provided by the legs 66, a spring 82, or both.

The illustrated spring 82 is diamond shaped and can be formed utilizing a side action mold. In addition, such springs 82 provide a force which acts directly along the axis of the spring 82. The undeformed legs of the spring 82 are at small angle Beta ($\beta$) with respect to the axis of liquid passage. In this state, the product of the force of biasing spring 82 and the 13 force vector in line with the passage is near maximum. As the positive liquid pressure within the bellows 60 acts upon surface the outlet valve member 80, the legs of the spring 82 flexibly rotate about the comers and angle Beta, ($\beta$), increases, thus decreasing the 13 force vector multiplier. Consequently, when this spring force component is great, compared to the spring force components due to the resiliency of the legs 66 and the resiliency of the spring 82 leg material, the outlet valve 75 and 80 may be biased in such a way that the biasing force of the spring 82 drops as the valve opens. Alternative springs (not seen) which may be utilized to bias the outlet valve 75 and 80 include helical springs and wavy plate springs. In addition, some or all of the biasing force may be provided by the legs 66 connecting the bellows 60 to the outlet valve member 80. Thus, the illustrated bellows 60 of the present invention includes an integral functional component of all of the internal downstream functions (i.e., the outlet valve—including the biasing element, and the swirl chamber) of this liquid dispensing pump device 20.

Figure 3:
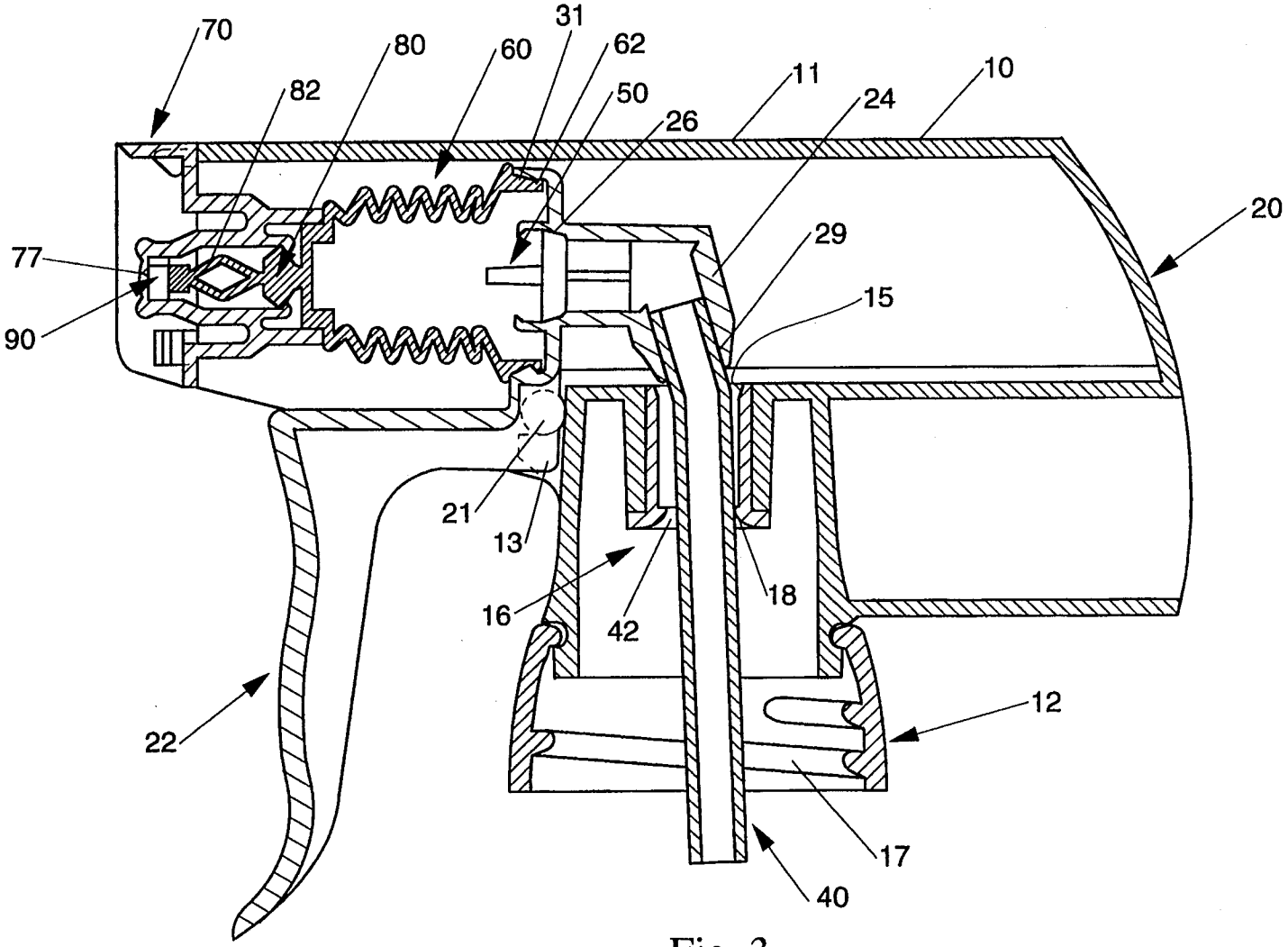
FIG. 3 is a cross-sectional view, similar to FIG. 2, of the liquid dispensing pump device in operation.

Referring to FIG. 3, operation of this liquid dispenser 20 involves manually depressing the trigger 22 causing rotation of the trigger 22 about the pivot 21. Since the trigger 22 is attached to the bellows 60 through the pump coupler 23, this rotational motion of the trigger 22 results in rotational manual compression of the bellows 60. The resultant compression creates a positive pressure within the bellows 60. Since the inlet valve 26 and 50 is not biased closed, this positive pressure forces the inlet valve 26 and 50 to close if it is not already closed. Thus, during this period of positive pressure downstream of the inlet valve 26 and 50, the inlet valve 26 and 50 is closed which prevents liquid inside the bellows 60 from returning to the container (not seen).

Simultaneously, this positive pressure in the bellows 60, upstream of the outlet valve 75 and 80 acts upon the outlet valve member 80 and when the pressure within the pump chamber 60 reaches a level high enough to cause flexure of legs 66 and spring 84, the outlet valve member 80 disengages from the outlet valve seat 75; opening the valve. Liquid in the bellows 60 then flows under pressure around the annular gap created between liquid outlet valve member 80 and outlet valve seat 75. The liquid continues to flow under pressure through spin chamber 90; i.e., spin channels 92 of the spinner 91 and out through the discharge orifice 77. As the liquid passes through the spin chamber 90 it gains a radial momentum prior to exiting the discharge orifice 77. The combination of radial and axial momentum causes the liquid to exit the discharge orifice 77 in a thin conical sheet which quickly breaks up into liquid particles. As an alternative to biasing the outlet valve 75 and 80 closed to generate pressure in the exiting liquid, the spin channels 92 (or the discharge orifice 77, for example) may operate as flow restrictions which result in increasing the pressure in the exiting liquid.

Rotation of the trigger 22 also results in the simultaneous opening of the vent valve 15 and 29. The vent valve member 29 at the end of the tubular pipe 24 is attached to the trigger 22 such that rotation of the trigger 22 moves the vent valve member 29 away from the vent valve seat 15. This provides a generally annular vent channel 42 between the vent tube 16 of the housing 10 and the dip tube 40. The vent channel 42 provides liquid communication between the interior of the container (not seen) and the atmosphere. Thus, air is able to flow from the atmosphere into the container (not seen) through this vent channel 42 to replace the volume of liquid being dispensed from the container (not seen). The vent tube 16 includes an annular rib 18 at its lower end which reduces the diameter of the vent channel 42 such that liquid will not readily splash out the vent channel 42 during operation. For example, the annular rib 18 preferably has an internal diameter which is about 0.005 inches larger than the outside diameter of the dip tube 40. Since the dip tube 40 is held by the rotating trigger 22, the diptube 40 flexes to follow the natural arc of the trigger 22. Alternatively, the vent valve opening may be large enough that no flexing of the dip tube 40 is required.

When the trigger 22 is released, the bellows 60 restores itself to its uncompressed state, through its resiliency. Alternatively, the bellows 60 may be aided in restoration by a spring (not seen) operating in conjunction with the bellows 60. Since the bellows 60 is attached to the trigger 22 through the coupler 23, restoration of the bellows 60 rotates the trigger 22 to its original position. As the bellows 60 returns to its original uncompressed state, a negative pressure, or vacuum, is created within the pump chamber 60. This negative pressure, upstream of the outlet valve 75 and 80, along with biasing spring 82 and the resiliency of the legs 66, causes the liquid outlet valve 75 and 80 to close. Simultaneously this negative pressure, downstream of the inlet valve 26 and 50, opens liquid inlet valve 26 and 50; allowing liquid to enter the bellows 60 through the diptube 40. The tabs 28 limit the amount of disengagement of liquid inlet valve member 50 so that it is properly located for closing upon the next manual actuation of the liquid dispensing pump device 20.

Referring to FIGS. 6 through 9, a second alternative embodiment of a liquid dispensing device 120 of the present invention is illustrated. This embodiment utilizes linear, instead of rotary, motion of the bellows 160.

The nozzle 170 is generally similar to nozzle 70. However, the nozzle 170 is slightly smaller in overall dimension and includes a lug 178 on each of its three sides and a depending wall 173 (seen in FIG. 8). Likewise, the bellows 160 is generally similar to the bellows 60. However, the bellows 160 includes a resilient annularly extending flange 161 near its inlet end which makes a cup seal against the inside of the housing 110.

Trigger 122 is substantially modified from that of FIG. 1. For example trigger 122 includes two upper elongated arms which each include a hinge 113. The hinges 113 cooperate with pivots 121 located on top of the shroud 111. Thus, the pivot point of this trigger 122 is located at the top of the housing 110. The trigger 122 also includes a push tab 119 which cooperates with the depending wall 173 of the nozzle 170 to enable linear compression of the bellows 160 upon manual actuation (i.e., rotation) of the trigger 122. Alternatively (not seen), the trigger 122 may be rigidly affixed to the nozzle 170 such that the trigger 122 is actuated through linear motion rather than rotational motion.

Likewise the housing 110 is substantially modified. For example the housing 110 includes channels 114 which cooperate with the three lugs 178 on the nozzle 170 to retain the nozzle 170 in place while allowing linear, reciprocating movement of the nozzle 170 relative to the housing 110. The housing 110 also includes the pump coupler 123 for the bellows 160 and an internal vertical wall 130 which provides an enclosed annular volume between it and the resilient flange 161 of the bellows 160. A vent hole 142 in the housing 110 provides fluid communication between this enclosed annular volume and the interior of the supply container (not seen). Similar to the inlet valve 26 and 50 of the previous embodiment, a poppet valve member 150 cooperates with a conically shaped inlet valve seat 126. In an alternative arrangement (not seen) the housing 110 can be modified to enclose a ball check valve member between the housing 110 and the diptube 140 in place of the illustrated inlet valve 126 and 150.

Figure 9:
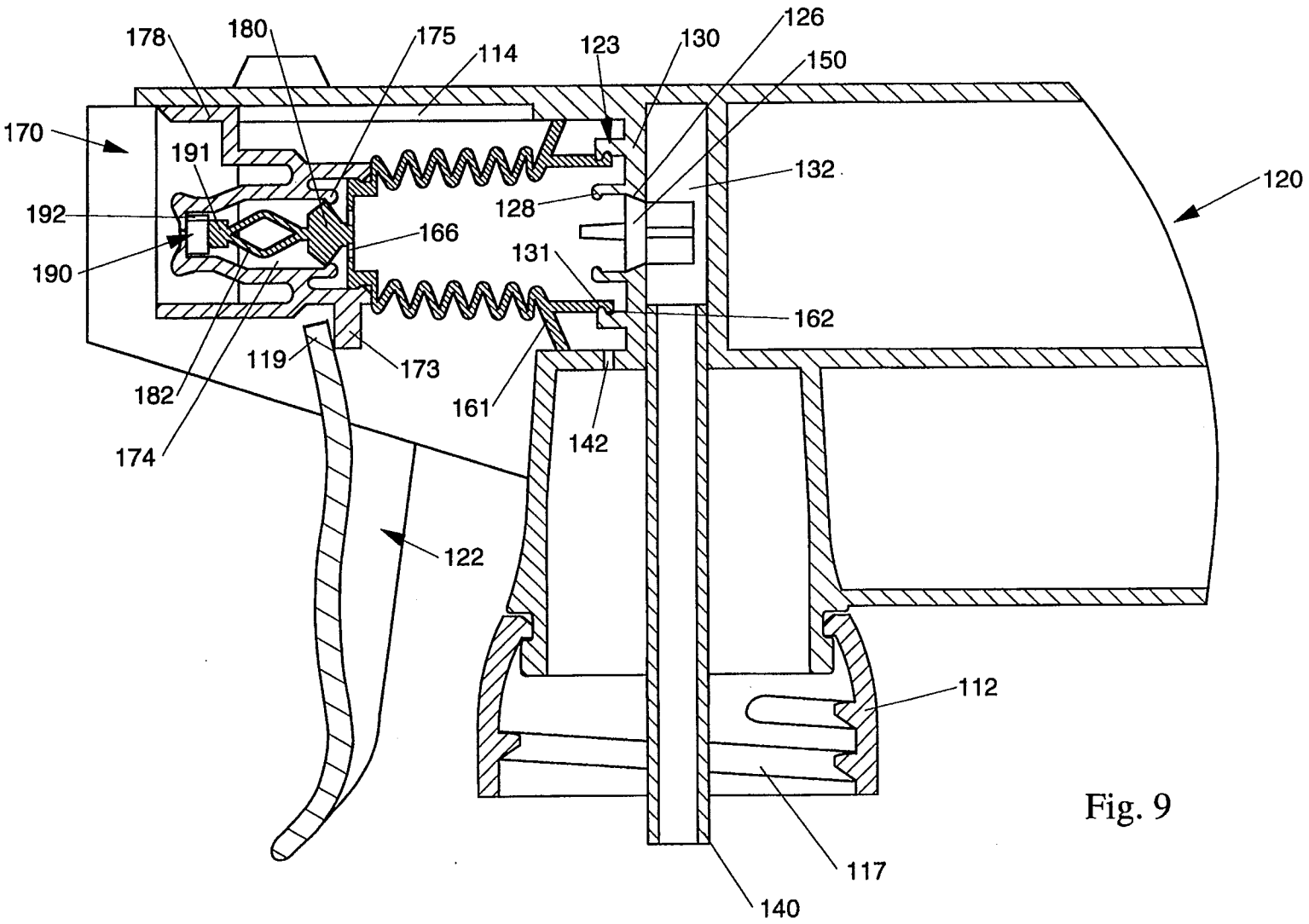
FIG. 9 is a cross-sectional view, similar to FIG. 3, of the liquid dispensing pump device of FIG. 6 in operation.

To dispense liquid product from the source container (not seen), the trigger 122 is manually operated, as seen in FIG. 9, such that the tab 119 cooperates with depending wall 173; resulting in the nozzle 170 moving back toward the closure 112 in a linear direction. The nozzle 170 is guided in this direction by the cooperation between the lugs 178 and the channels 114. As the nozzle 170 moves back the bellows 160 is compressed which results in closing of the inlet valve 1126 and 150 and opening of the outlet valve 175 and 180 allowing liquid to be sprayed through the swirl chamber 190. The liquid flows into the swirl chamber 190 through swirl channels 191 which, in combination with the side wall, causes the fluid to spin as it exits the discharge orifice 177. Thus, liquid product is sprayed from the supply container (not seen).

Upon release of the trigger 122, the resiliency of the bellows 160 acts like a spring and expands, returning to its original shape. Alternatively, a spring (not seen) may be added to provide additional resiliency. The expansion of the bellows 160 creates a negative pressure therein. During this period of negative upstream pressure, the outlet valve 175 and 180 closes. Also during this period of negative downstream pressure, the inlet valve 126 and 150 opens; allowing product to flow into the bellows 160 for the next dispensing operation. Simultaneously, air may pass through the cup seal vent valve created by the annular flange 161 of the bellows 160 and the inner surface of the housing 110, if sufficient negative pressure is generated within the container (not seen). Thus, the container (not seen) is vented and the liquid dispensing pump device 120 is primed for the subsequent dispensing operation.

Figure 10:
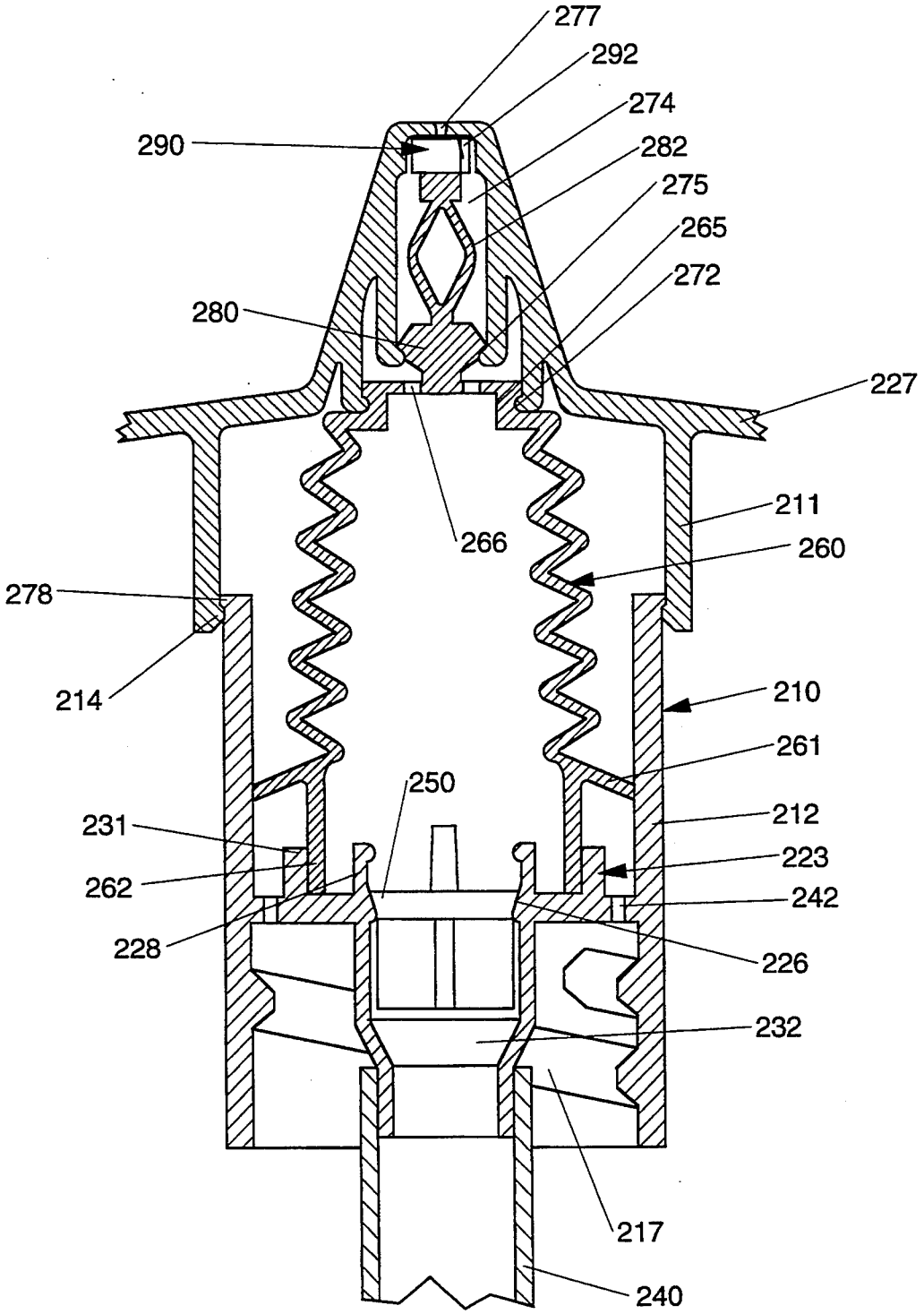
FIG. 10 is a cross-sectional view, similar to FIG. 8, of another particularly preferred liquid dispensing pump device of the present invention.
Figure 11:
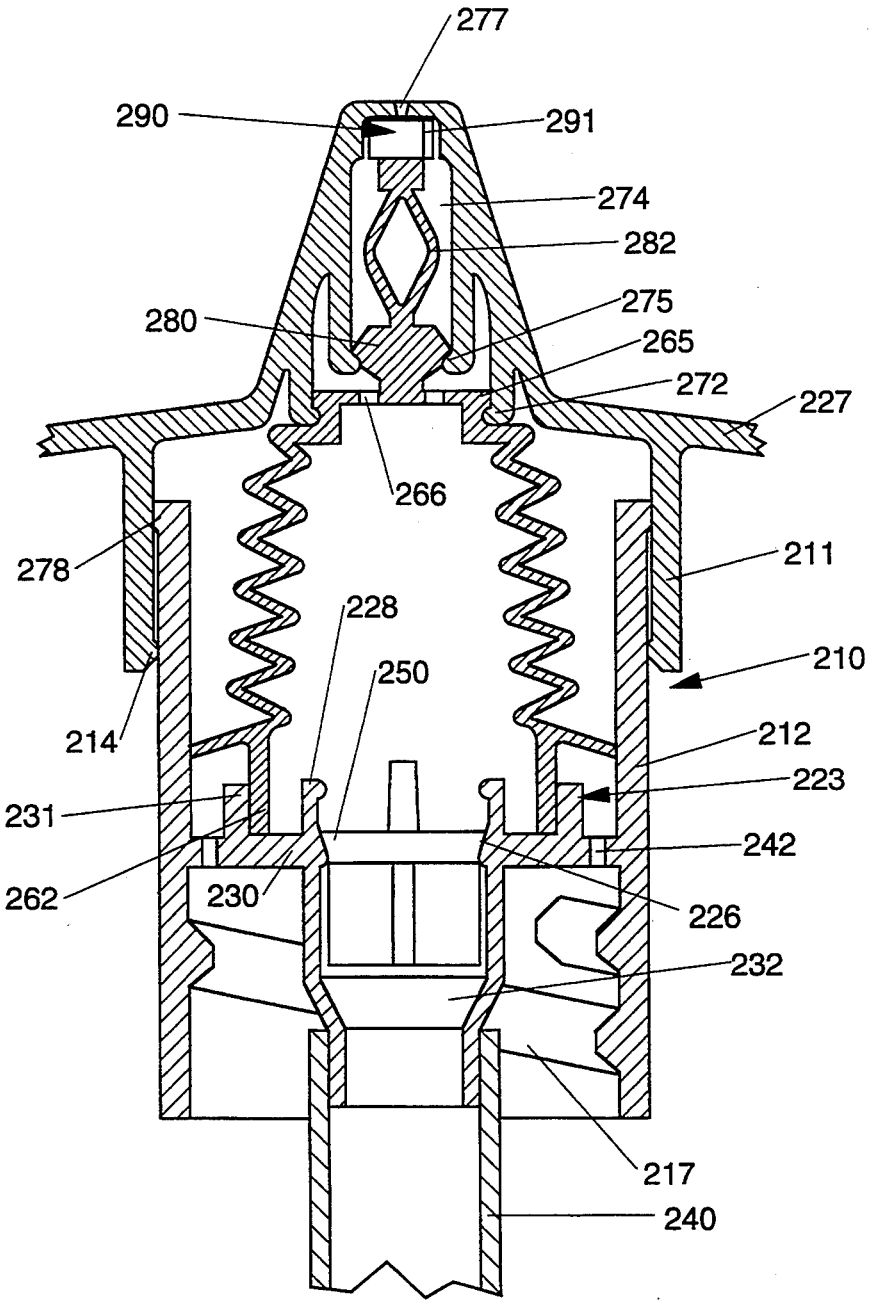
FIG. 11 is a cross-sectional view, similar to FIG. 9 of the assembled liquid dispensing pump device of FIG. 10 in operation.

A second alternative embodiment of a dispensing device 220 is illustrated in FIGS. 10 and 11, which provides a linearly actuated, reciprocating upward dispensing pump device. Such linearly actuated, upward dispensing devices 220 are commonly utilized to dispense nasal medicament products; e.g., decongestants. Thus, the housing 210 is substantially modified to provide the correct orientation of the spray and includes an upper housing 211 and a lower housing 212 telescoped onto each other and retained by cooperating annular ribs 214 and 278. The upper housing 211 includes an annular flange 227 which provide a means for manually actuating the dispensing pump device 220. Similar to the previous embodiments, the lower housing 212 includes screw threads 217, a vent channel 242, a pump coupler 223, retaining tabs 228, an inlet passage 232, and an inlet valve seat 226; and the upper housing 211 includes an outlet passage 274 cooperating rib 272, outlet valve seat 275, and dispensing orifice 277. Furthermore, the bellows 260 and dip tube 240 are substantially identical (though smaller) to those of the previous embodiments.

Operation of this spray device 220 is accomplished by placing the thumb on the bottom of the container (not seen) and the two middle fingers on the flange 227. As the fingers and thumb are brought together the upper housing 212 and the lower housing 211 are brought towards each other and the bellows 260 is compressed. This results in a positive pressure within the bellows 260. The inlet valve member 250 is sealed against the inlet valve seat 226 (thereby closing the inlet valve) during this period of positive upstream pressure. Pressure continues to build within the bellows 260 until the biasing force of the outlet valve member 280 against the outlet valve seat 275 is overcome. At that point the outlet valve 275 and 280 opens; allowing liquid to be dispensed through the dispensing orifice 277 of the swirl chamber 290.

Upon release of the manual compressive force, the bellows 260 returns through its resiliency to its uncompressed state creating a negative pressure within the bellows 260. During this period of negative pressure, the outlet valve 275 and 280 closes and the inlet valve opens 226 and 250 which moves liquid from the supply container (not seen) into the bellows 260; thereby priming the bellows 260 for the next dispensing operation. Simultaneously, air may pass through the cup seal vent valve created by the annular flange 261 of the bellows 260 and the inner surface of the housing 210, if sufficient negative pressure is generated within the container (not seen). Thus, the container (not seen) is vented and primed for the subsequent dispensing operation.

As discussed previously, the collapsible pump chamber of the present invention most preferably includes integral functional elements of the downstream functions; e.g., the outlet valve, the outlet valve biasing element, and/or the swirl chamber. FIGS. 12 through 15 illustrate alternative bellows embodiments which may also be utilized; e.g., in any of the dispensing devices previously described. To eliminate duplication, however, these alternative bellows are illustrated with respect to the liquid dispensing pump device 20 of FIG. 1 only.

Figure 12:
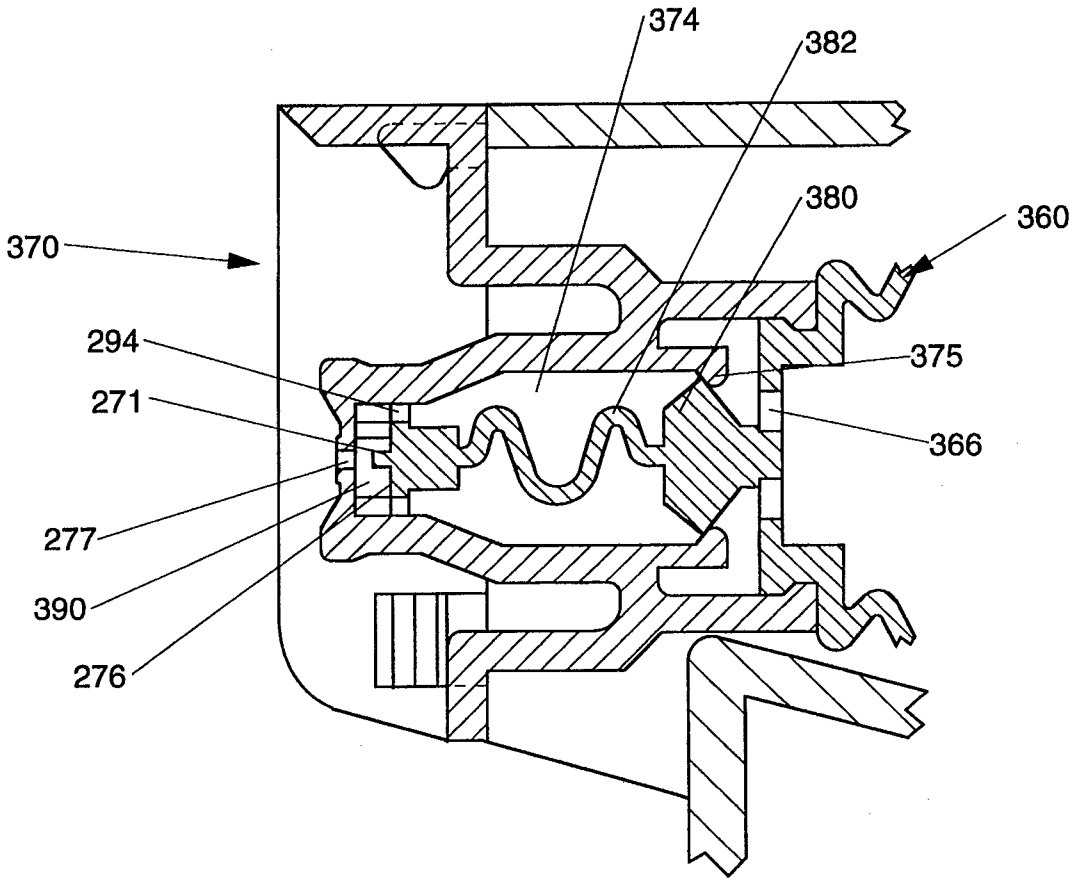
FIG. 12 is an enlarged, fragmentary cross-sectional view, similar to FIG. 5, of an alternative preferred embodiment of the present invention.

The alternative bellows 360 of FIG. 12 utilizes a spring 382 having a linearly increasing spring force. In addition to the spring 382, a portion of the biasing force may be provided by the legs 366. Such springs 382 are commonly utilized to hold spinners 391 in place in typical spray pump devices; particularly trigger sprayers. Additionally, the spin channels 391 of the swirl chamber 390 are integral with the nozzle 370, rather than integral with the bellows 360. Thus, the bellows 360 provides the second part delineating the swirl chamber 390; an end wall 276. Although the end wall 276 could be provided by a simple post, the end wall 276 preferably includes a cylindrical projection 271 into the middle of the swirl chamber 290 which aids in imparting rotational, tangential momentum to the exiting liquid. Radial arms 294 maintain the end wall 276 in proper axial orientation with respect to the remainder of the swirl chamber 290.

Figure 13:
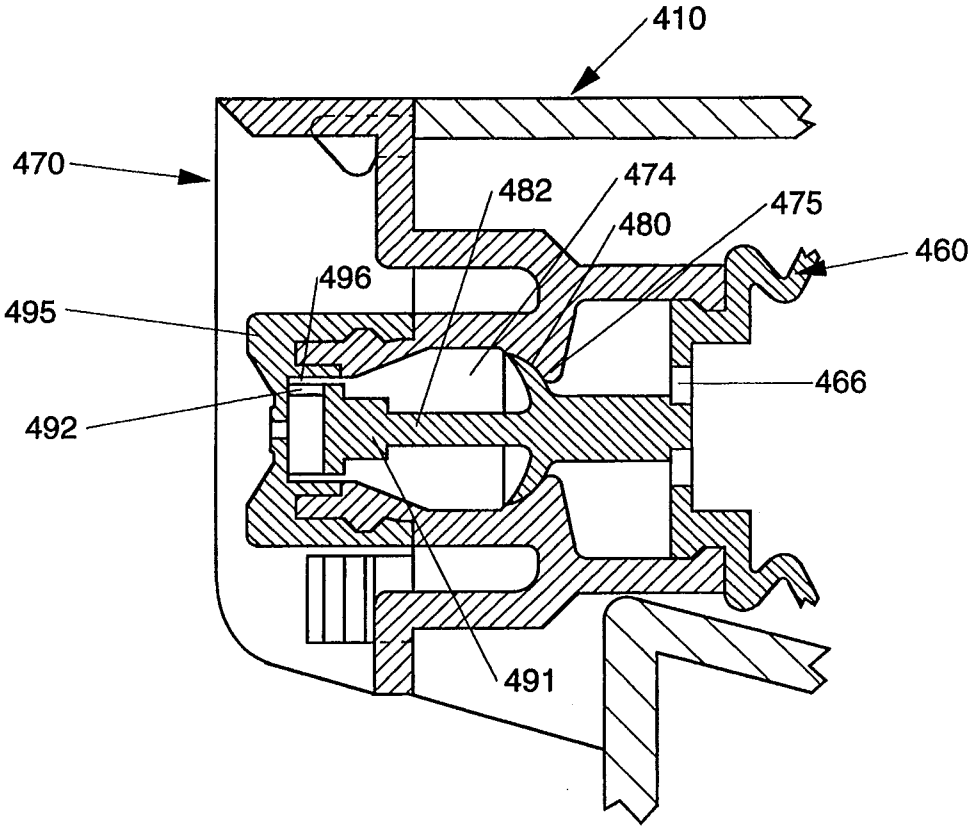
FIG. 13 is an enlarged, fragmentary cross-sectional view, similar to FIG. 5, of an alternatives,preferred embodiment of the present invention.

The alternative bellows 460 of FIG. 13 utilizes a rod 482 in lieu of the spring and a cup seal outlet valve member 480 in lieu of the poppet-type outlet valve member 80. The spring 82 is not necessary because the outlet valve member 480 may be biased simply by controlling the length of the rod between the bellows 460 and the outlet valve member 480 and/or the length of the rod 482 between the outlet valve member 480 and the spinner 491. Furthermore, the central portion of the outlet valve member 480 does not need to move axially, since the outlet valve 475 and 480 opens through movement of the circumferential portions of the valve member 480.

This embodiment also includes a shipping seal which is opened and closed by rotation of a portion 495 of the nozzle 470. The shipping seal is closed when rotation of the nozzle portion 495 results non-alignment of channels 496 in the nozzle portion 495 with the spin channels 492 of the spinner 491. Conversely, the shipping seal is open when rotation of the nozzle portion 495 results alignment of the channels 496 in the nozzle portion 495 with the spin channels 492 of the spinner 491. In an alternative arrangement (not seen), the nozzle 470 may be a single integral part which is permitted to rotate between open and closed positions. This alternative arrangement may require the addition of cooperating slots and tabs on the housing 410 and the bellows 460, respectively, to prevent inadvertent rotation of the bellows 460 (and consequently the spinner 491) during rotation of the nozzle 470.

Figure 14:
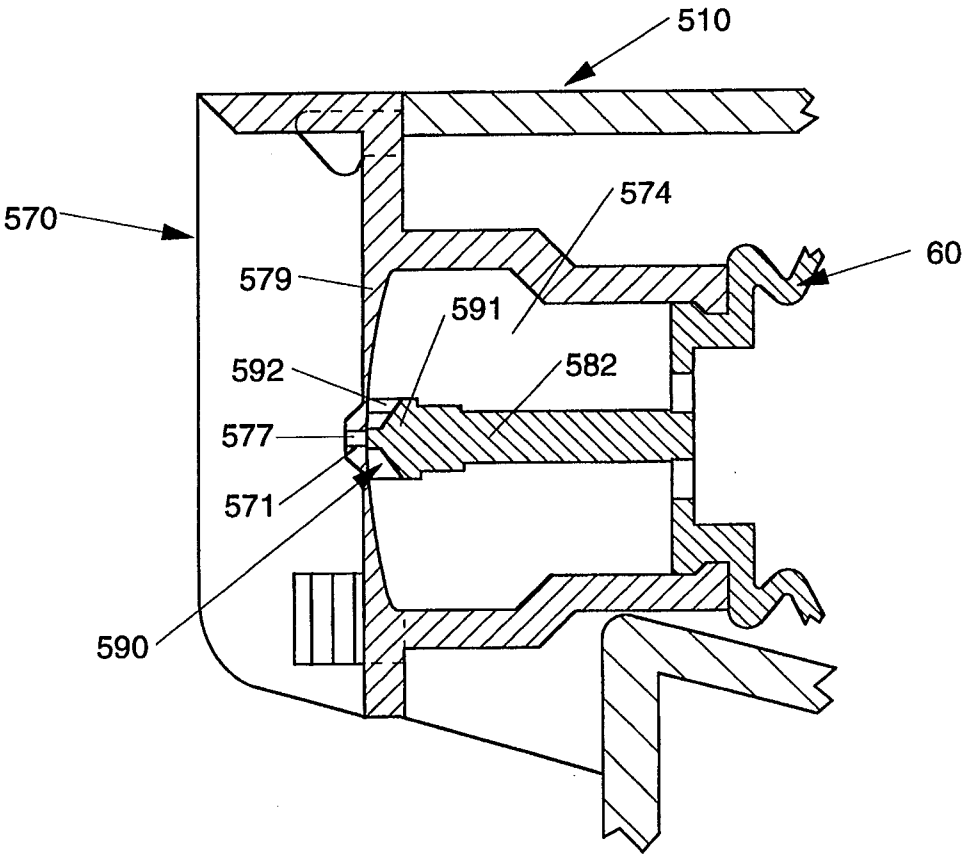
FIG. 14 is an enlarged, fragmentary cross-sectional view, similar to FIG. 5, of an alternative preferred embodiment of the present invention.

The bellows 560 of FIG. 14 includes a rod 582 in place of the spring 82 and the spin channels 592 are located on the nozzle 570, similar to FIG. 11. The nozzle 570 of this embodiment, however, includes a flexible membrane 579 which operates in conjunction with the cylindrical portion 571 of the post 591 as the outlet valve. The flexible membrane 579 operates as an outlet valve member and the post 571 operates as the valve seat. As the bellows 560 is compressed, the fluid behind the flexible membrane 579 is under positive pressure. Consequently, an outward force on the flexible membrane 579 causes the membrane 579 to flex outwardly. Upon outwardly flexing the discharge orifice 577 moves away from the cylindrical portion 571 of the post 591; thereby allowing the liquid to be sprayed. This construction is beneficial because the flexible membrane 579 and the cylindrical portion 571 of the post 591 can be structured to cause precompression. Furthermore, since the outlet valve 571 and 591 is at the terminal end of the liquid passage post spray dripping is significantly reduced.

Figure 15:
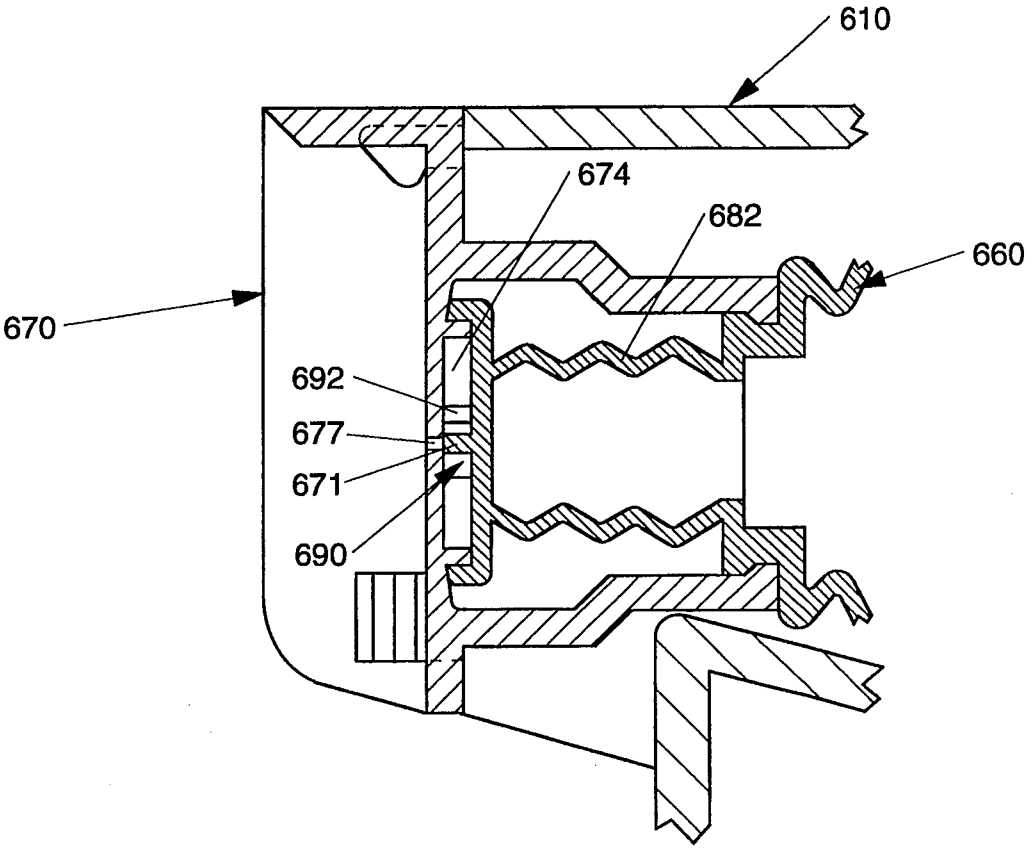
FIG. 15 is an enlarged, fragmentary cross-sectional view, similar to FIG. 5, of an alternative preferred embodiment of the present invention.

The bellows 660 of FIG. 15 is essentially the reverse of FIG. 14. The bellows 660 includes the flexible membrane 659 which moves backward in response to positive pressure within the bellows 660. Thus, the outlet valve is comprised of the post 671 and the nozzle 670.

Although particular embodiments of the present invention have been illustrated and described, modifications may be made without departing from the teachings of the present invention. For example, the liquid may be discharged in a simple liquid stream (as in with a lotion pump) wherein the nozzle is an open channel; or as a foam wherein air is mixed with the liquid (e.g., through use of a venturi) at or near a foam forming device (e.g., a screen or static mixer). Accordingly, the present invention comprises all embodiments within the scope of the appended claims.

What I claim is:

1. A manually operated dispensing device for pumping a liquid from a supply container and spraying the liquid through a discharge orifice comprising:

(a) a housing for sealingly mounting the dispensing pump to the supply container, the housing including a portion of a liquid passage providing fluid communication from the supply container downstream to the discharge orifice;

(b) a swirl chamber, including a swirl channel and a discharge orifice, defining the terminal portion of the liquid passage, the swirl chamber being delineated by a first functional element including the discharge orifice and a second functional element;

(c) an inlet valve located within the liquid passage, the inlet valve being closed to prevent fluid flow therethrough during periods of positive downstream pressure and being open to permit fluid flow therethrough during periods of negative downstream pressure;

(d) an outlet valve located downstream of the inlet valve within the liquid passage, the outlet valve being open to permit fluid flow therethrough during periods of positive upstream pressure and being closed to prevent fluid flow therethrough during periods of negative upstream pressure;

(e) a collapsible pump chamber defining a portion of the liquid passage downstream of the inlet valve and upstream of the outlet valve, the collapsible pump chamber including the second functional element of the swirl chamber as an integral component thereof.

2. A manually operated dispensing device according to claim 1 wherein the outlet valve includes an outlet valve member and an outlet valve seat as functional elements thereof, and wherein the collapsible pump chamber includes a functional element of the outlet valve as an integral component thereof.

3. A manually operated dispensing device according to claim 2 wherein the outlet valve is biased closed by a biasing feature and a functional element of the biasing feature is an integral component of the collapsible pump chamber.

4. A manually operated dispensing device according to claim 3 wherein the integral functional element of the swirl chamber is adjacent the integral functional element of the biasing feature and wherein the integral functional element of the biasing feature is adjacent the integral functional element of the outlet valve.

5. A manually operated dispensing device according to claim 1 wherein the outlet valve is biased closed by a biasing feature and a functional element of the biasing feature is an integral component of the collapsible pump chamber.

6. A manually operated dispensing device for pumping a liquid from a supply container and dispensing the liquid through a discharge orifice comprising:

(a) a housing for sealingly mounting the dispensing pump to the supply container, the housing including a liquid passage providing fluid communication from the supply container downstream to the discharge orifice;

(b) an inlet valve including a moveable valve member and located within the liquid passage, the inlet valve being closed to prevent fluid flow therethrough during periods of positive downstream pressure and being open to permit fluid flow therethrough during periods of negative downstream pressure;

(c) an outlet valve including a moveable valve member and located downstream of the inlet valve within the liquid passage, the outlet valve being open to permit fluid flow therethrough during periods of positive upstream pressure and being closed to prevent fluid flow therethrough during periods of negative upstream pressure;

(d) a biasing feature for biasing the outlet valve, the inlet valve, or both closed, the biasing feature including a functional element acting against the relevant moveable valve member to provide some portion of the biasing force; and (e) a collapsible pump chamber defining a portion of the liquid passage downstream of the inlet valve and upstream of the outlet valve, the functional element of the biasing feature being an integral component of the collapsible pump chamber.

7. A manually operated dispensing device according to claim 6 wherein the biasing feature includes a spring, a resilient arm, or both as a functional element thereof.

8. A manually operated dispensing device according to claim 7 wherein a functional element of the biasing feature is a spring capable of being formed via side action molding.

9. A manually operated dispensing device according to claim 8 wherein the spring provides an axial spring force.

10. A manually operated dispensing device according to claim 8 wherein the integral functional element of the biasing feature acts upon a functional element of the outlet valve which is also an integral component of the collapsible pump chamber.

11. A manually operated dispensing device according to claim 10, further comprising a functional element of a swirl chamber which is also an integral component the collapsible pump chamber.

12. A manually operated dispensing device according to claim 6 wherein the integral functional elements of the biasing feature provides a biasing force which is sufficient to provide precompression.

13. A manually operated dispensing device according to claim 6 further comprising a functional element of a swirl chamber which is also an integral component the collapsible pump chamber.

14. A manually operated dispensing device for pumping a liquid from a supply container and dispensing the liquid through a discharge orifice comprising:

(a) a housing for sealingly mounting the dispensing pump to the supply container, the housing including a liquid passage providing fluid communication from the supply container downstream to the discharge orifice;

(b) an inlet valve located within the liquid passage, the inlet valve being closed to prevent fluid flow therethrough during periods of positive downstream pressure and being open to permit fluid flow therethrough during periods of negative downstream pressure;

(c) an outlet valve located downstream of the inlet valve within the liquid passage, the outlet valve being open to permit fluid flow therethrough during periods of positive upstream pressure and being closed to prevent fluid flow therethrough during periods of negative upstream pressure;

(d) a collapsible pump chamber defining a portion of the liquid passage downstream of the inlet valve and upstream of the outlet valve, the outlet valve including a valve member which is capable of being biased closed against a cooperating valve seat by an axial biasing force, the valve member being an integral component of the collapsible pump chamber.

15. A manually operated dispensing device according to claim 14 further including a biasing feature for biasing the outlet valve member closed, the biasing feature including a functional element which provides some portion of the biasing force which is an integral component of the collapsible pump chamber.

16. A manually operated dispensing device according to claim 15 wherein the biasing feature includes a spring, a resilient arm, or both as a functional element thereof.

17. A manually operated dispensing device according to claim 16 wherein a functional element of the biasing feature is a spring capable of being formed via side action molding.

18. A manually operated dispensing device according to claim 17 wherein the spring provides an axial spring force.

19. A manually operated dispensing device according to claim 17 further comprising a functional element of a swirl chamber which is also an integral component of the collapsible pump chamber.

20. A manually operated dispensing device according to claim 14 wherein the integral functional elements of the biasing feature provides a biasing force which is sufficient to provide precompression.

* * * * *

UNITED STATES PATENT AND TRADEMARK OFFICE

CERTIFICATE OF CORRECTION

PATENT NO. : 5,439,178

DATED : August 8, 1995

INVENTOR(S) : Robert J. Peterson

It is certified that error appears in the above-identified patent and that said Letters Patent is hereby corrected as shown below:

*Column 3, line 41, the first "to" should read --the--.*

*Column 6, line 9, "downstream" should read --upstream--.*

*Column 6, line 26 "72" should read --75--.*

*Column 6, line 46 "90" should read --91--.*

*In drawing Fig. 1, "71" should read --77--.*

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*